United States Patent [19]

Amos

[11] Patent Number: 4,599,804

[45] Date of Patent: Jul. 15, 1986

[54] LINE GUIDE

[76] Inventor: Matthew P. Amos, 3602 Bonny Brook Rd., Harrisburg, Pa. 17109

[21] Appl. No.: 603,422

[22] Filed: Apr. 24, 1984

[51] Int. Cl.[4] ..... G01C 15/10

[52] U.S. Cl. ..... 33/408; 33/410

[58] Field of Search ..... 33/404, 407, 408, 409, 33/410; 403/346, 347, DIG. 9; 269/207, 210

[56] References Cited

U.S. PATENT DOCUMENTS

| | | | |
|---|---|---|---|
| 2,215,663 | 9/1940 | Frisk | 33/408 |
| 2,492,044 | 12/1949 | Hulquist | 33/410 |
| 2,659,973 | 11/1953 | Patzel | 33/410 |
| 3,119,186 | 1/1964 | Stewart | 33/408 |
| 3,327,395 | 6/1967 | Zenke | 33/407 |

*Primary Examiner*—Charles Frankfort
*Assistant Examiner*—Patrick R. Scanlon
*Attorney, Agent, or Firm*—John S. Roberts, Jr.

[57] ABSTRACT

An improved bricklayer's guide, and more particularly, a simplified and efficient adjustable support for the line used by masons as a guide for laying successive layers of bricks or blocks of various sizes. The bricklayer's guide or "line dog" consists of a combination of notched posts or standards that will cooperate in providing the desired width and a series of notches on one post that will engage an offset notch on a second post to provide the desired adjustment and secure the guide in place.

7 Claims, 2 Drawing Figures

LINE GUIDE

FIELD OF THE INVENTION

The present invention relates generally to improvements in stonemason or bricklayer's guides, and more particularly to a novel and more efficient and practical device of this kind which has an application in the building of walls of either bricks or blocks of various sizes.

BACKGROUND OF THE INVENTION

As is well known, a basic tool used by brickmasons in the construction process is the bricklayer's guide or "line dog." This device, also commonly known as a "line stretcher," functions as a means for securing and holding sections of twine or cord that serve as a guide for laying successive courses of brick or block during the construction of a wall or the like.

Presently, tools of this sort can generally be classified as falling into either one of two catagories, adjustable or non-adjustable.

The disadvantage that can be seen with the non-adjustable type guides is that such a guide requires the use of a separate tool to accomodate various sizes of blocks necessitating the purchase of a variety of guides of various widths.

Adjustable guides generally consist of a variety of cooperating metalic pieces which are held together by a securing means such as bolts and wing-nuts. In order to adjust such a tool for different size building blocks or bricks, the adjustable securing means must be removed and the tool appropriately re-set. After setting the tool to the desired demension, said bolts or similar means are reinserted into a variety of configurations of matching holes, or upon a predetermined place along the metallic piece and retightened so as to secure the device in its adjusted position.

Common disadvantages in this type of arrangement are that morter tends to harden in the threads of said bolts making the nuts difficult to remove. Also, bolt threads tend to become battered with use, making assembly and disassembly difficult. Moisture will also generally cause the bolting means to rust, making separation and adjustment difficult. Combined with the above is the additional disadvantage associated with the problem of dropping or otherwise losing the nut or bolt adjusting means in the work enviornment.

U.S. Pat. No. 2,728,142 issued to Betterton and U.S. Pat. No. 3,318,004 issued to Payne, in addition to providing examples of many of the disadvantages set out above, also point to the novelty and desirability of another aspect of the present invention namely, its efficient means of securing itself to the building surface.

As can be readily seen from the above cited examples of prior art in the field, in addition to a means for adjusting a guide device to accomodate widths of building block, a simple and efficient means of securing the device itself in a manner that would provide a stable platform from which to run a guideline would be desirable. U.S. Pat. No. 3,318,004 to Payne, for example, utilizes a conical member set in a concrete block. U.S. Pat. No. 2,728,142 to Betterton, on the other hand, utilizes a series of bolting means which has many of the disadvantages of similar means utilized in adjusting the width of the device as was set out above.

Unlike the cited examples, the guide of present invention utilizes a simplified and efficient means of securing itself to the building surface, whereby said improved guide is capable of frictionally securing itself by utilizing the tension produced by the guideline, thus doing away with the need for means such as a bolting mechanism or weighted base member.

SUMMARY OF THE INVENTION

The foregoing and other objectives of the present invention are achieved through the provision of a combination of at least two intercommunicating members made of stainless steel or other suitable material. The first, or base member, in its preferred embodiment is constructed in a "T" configuration utilizing a series of notches cut into the edge of said member at prescribed and predetermined locations. Said notches serve to provide a means to precisely adjust the guide to the desired demensions.

The second or adjustable member may also be constructed in a "T" configuration. Said adjustable member contains at least one notch cut along the longest section of the "T" bar at a predetermined location. On either side of said notch, the bar is bent at opposite 90° angles resulting in an "S" configuration. The disposition of said notch between said 90° bends permits the cooperative mating of the notch with the desired notch disposed upon the base member. As a result of said mating, the short sections of the "T" configuration are thereby disposed adjustably parallel to each other.

Said shorter sections are themselves provided with notches at predetermined locations which provide for the disposition of the guide line which is secured in conjunction with a second device on the end disposed above the building line. The opposite ends of the shorter "T" bars are disposed on either side of the brick and are thus capable of frictionally securing the guide to the brick or block by a pivot means resulting from the tension produced by the disposition of the guide line member thereon.

DESCRIPTION OF THE FIGURES

Various additional objects, features, and advantages of the invention will be better understood from the following description when considered in conjunction with the accompanying Figures, to wit.

SPECIFIC DISCLOSURES

Figure 1:
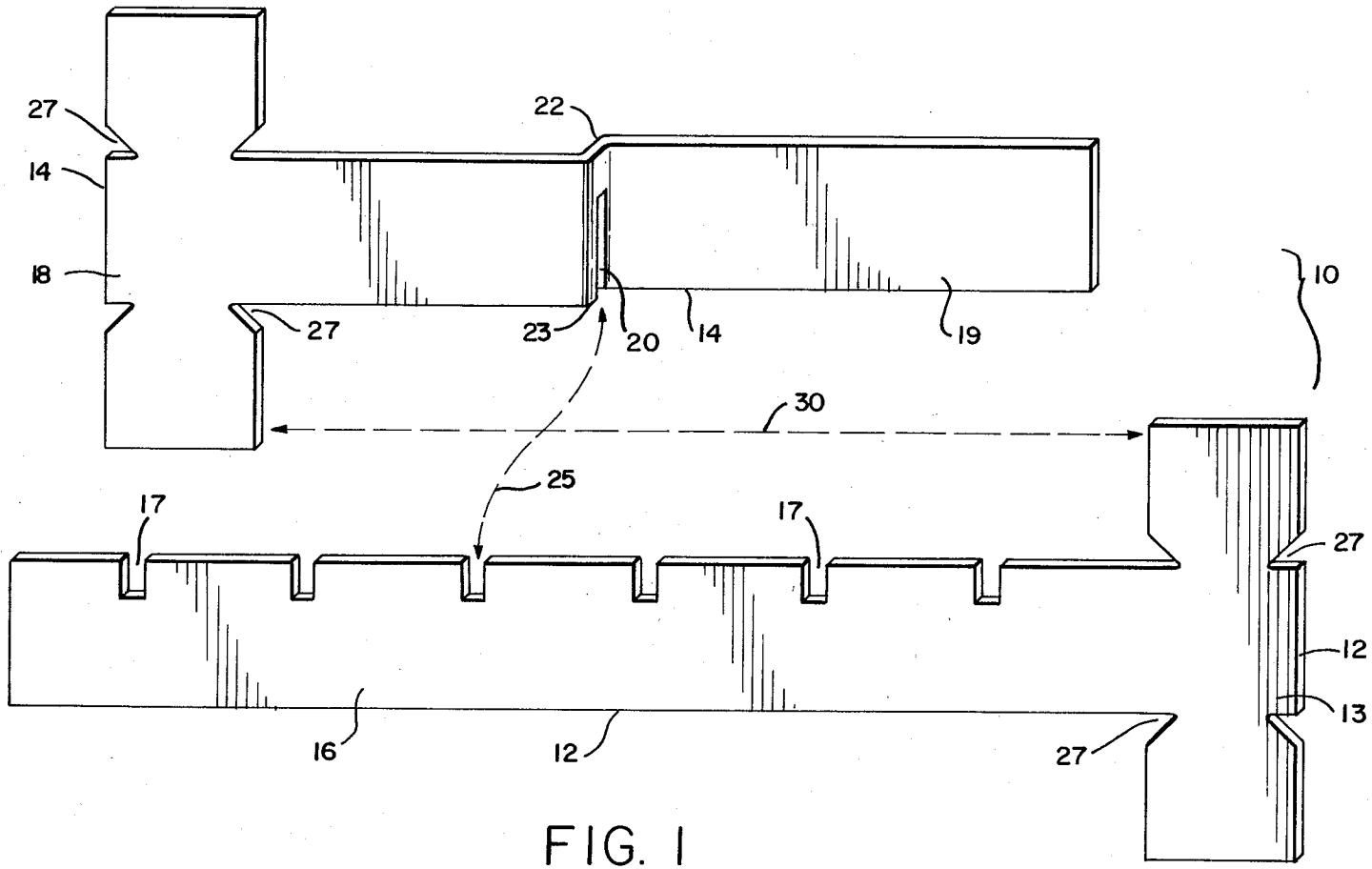
FIG. 1 is a perspective view of the improved line guide showing its component and cooperating parts.

Referring to the drawings and more particularly to FIG. 1 thereof, the improved line guide is generally indicated by character 10. The guide is comprised of at least two intercommunicating members 12 and 14, which can be made of stainless steel or other suitable rigid and durable material. The first, or base member 12, in its preferred embodiment, is constructed in a "T" configuration in which said base member 12, contains a "T" post 13 on one end which is disposed perpendicular to the main body of the member 16. The main body member 16, contains a series of notches 17, which are cut into at least one edge of said member 16 at predetermined locations. Said notches 17, for the preferred usage, would be spaced at increments corresponding to the incremental increase of the width of common standardized bricks and blocks used in the building trade. The notches 17 may thus serve to provide a means to precisely adjust the guide 10 to desired dimensions corresponding to standardized building materials.

The second, or adjustable member 14, may also be constructed in a "T" configuration. Like the base member 12, the adjustable member 14 contains a "T" post 18 on one end, which is disposed perpendicular to the main body of the member 19. Said member 19 contains at least one notch 20 disposed on the side of said member 19. On either side of said notch 20, the member 19 is bent at opposite 90° angles 22, 23, resulting in a "S" configuration. The disposition of the notch 20 between said 90° bends 22,23, permits the cooperative mating of the notch 20 with the desired notch 17 disposed on the main body 16 of the base member 12. As a result of said mating 25, the posts 13 and 18 are thereby disposed adjustably parallel to each other 30.

The posts 13, 18, are in turn provided with notches 27 at predetermined locations in order to receive and properly dispose a guideline.

Figure 2:
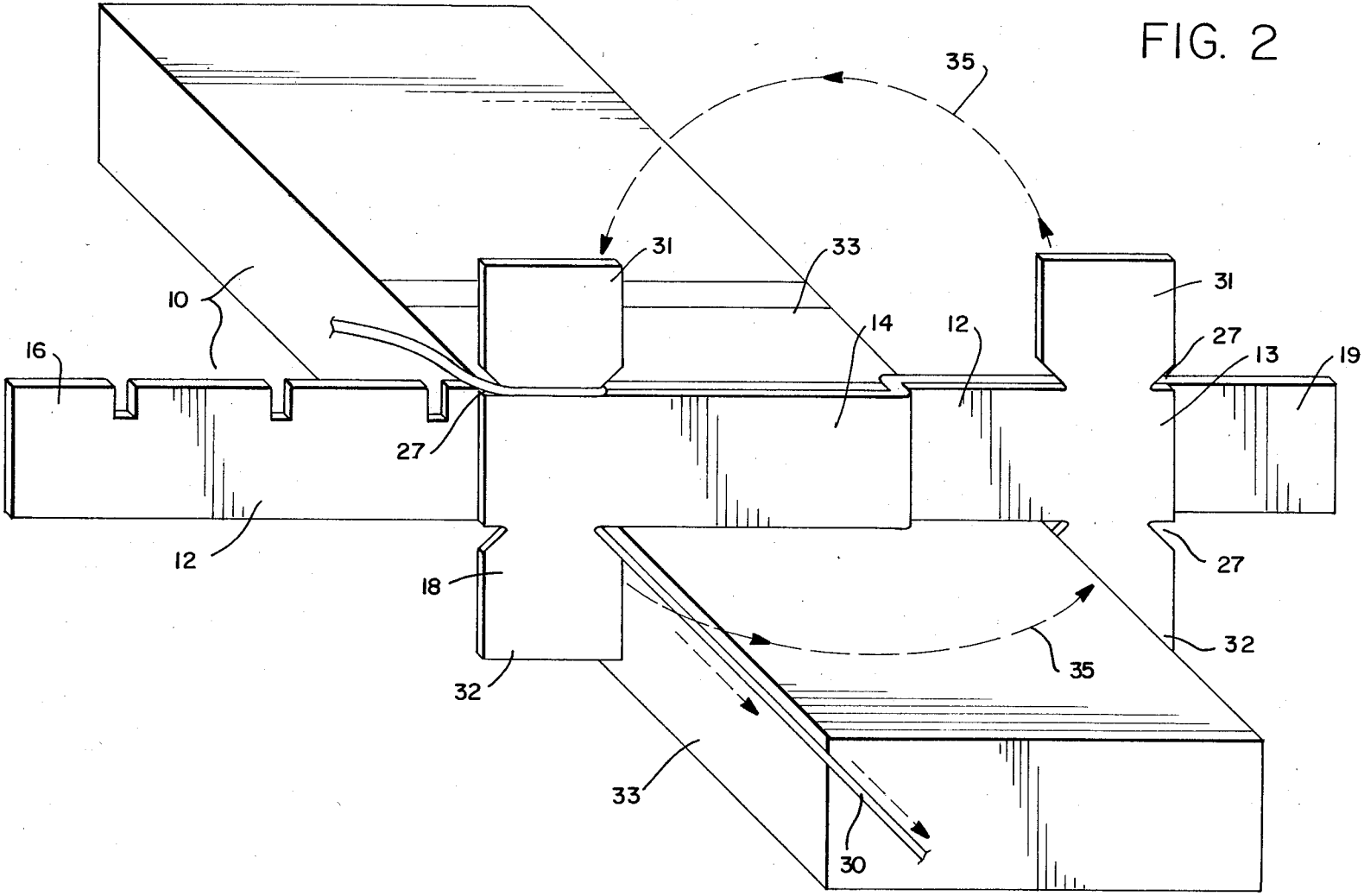
FIG. 2 is a perspective view of the improved line guide showing its disposition and application during construction of a structure.

FIG. 2 shows the application and disposition of the improved line guide after proper adjustment and mating of the base member 12 and the adjustable member 14. As can be readily seen, the improved line guide is disposed upon a brick or the like, with the post members 13 and 18, fitted parallel to said brick. In its preferred disposition, the main body member 16 is set out on the side of the wall away from the bricklayer. Notches 27 are disposed upon the "T" post members 13, 18, at predetermined locations which will accept a guideline 30 consisting of string or twine of any suitable material. Said guideline 30 may be disposed around the post member 18 of the guide 10 in conjunction with a preferred second line guide (not shown) at a point on that end of the post located above the building line 31. The ends of the post 13, 18 that are located below the building line 32 frictionally secure the line guide 10 to the building surface 33 by a rotation means 35, resulting from the tension produced by the disposition of a preferred single guide line member 30.

What is new and desired to be secured by Letters Patent is:

1. An improved line guide comprising a base member consisting of a main body and a "T" post, the main body of said base member containing a series of notches, an adjustable member consisting of a main body and a "T" post, the main body of said adjustable member containing at least one offset notch that is disposed so as to permit the cooperative mating of said offset notch with any one of the series of notches on the main body of the base member, thus providing a means of adjustably and cooperatively combining said members and further providing a means of adjustably and removably securing said members to a construction surface, and a means of removably securing a guide line to said guide.

2. The improved line guide of claim 1, wherein said line guide is constructed of material that is rigid and durable.

3. The base member of claim 1, wherein said series of notches is disposed along the main body of said member at points corresponding to the width of standardized building materials.

4. The base member of claim 1 wherein at least one notch is disposed upon the "T" post of said member.

5. The improved line guide of claim 1, wherein the adjustable member is bent at opposite 90° angles at points on either side of said offset notch.

6. The improved line guide of claim 1, wherein said guide frictionally secures itself to a building surface by by rotation of said guide caused by tension in said guide line.

7. The adjustable member of claim 1, wherein at least one notch is disposed upon the "T" post of said member.

* * * * *